US006200168B1

(12) United States Patent
Ko

(10) Patent No.: US 6,200,168 B1
(45) **Date of Patent: *Mar. 13, 2001**

(54) CONNECTOR ASSEMBLY HAVING ANTI-DISORTIENTATION DEVICE

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/244,251

(22) Filed: Feb. 3, 1999

Related U.S. Application Data

(63) Continuation-in-part of application No. 09/196,859, filed on Nov. 20, 1998, now Pat. No. 6,135,815.

(51) Int. Cl.[7] ..... H01R 13/64
(52) U.S. Cl. ..... 439/677; 439/608
(58) Field of Search ..... 439/680, 595, 439/594, 603, 677, 877, 681, 878–882, 374, 607–610

(56) References Cited

U.S. PATENT DOCUMENTS 4,979,912 * 12/1990 Shindo et al. ..... 439/595
6,022,246 * 2/2000 Ko ..... 439/680

* cited by examiner

*Primary Examiner*—Gary Paumen
(74) *Attorney, Agent, or Firm*—Wei Te Chung

(57) ABSTRACT

A connector assembly comprises a male connector defining at least two cavities within a first outer peripheral wall and a partition arranged therebetween. Each cavity has a header contact assembled therein. A female connector forms at least two sleeve members corresponding to the cavities. Each sleeve member receives a receptacle contact therein. The sleeve member mechanically engages with the corresponding cavity when the male and female connectors are mated. A second peripheral wall surrounds the sleeve members extending from the female connector. The second peripheral wall and the outer sleeve members define a gap therebetween for receiving the first peripheral wall therein.

1 Claim, 4 Drawing Sheets

CONNECTOR ASSEMBLY HAVING ANTI-DISORTIENTATION DEVICE

This is a Continuation-in-Part application of Ser. No. 09/196,859 filed Nov. 20, 1998, now U.S. Pat. No. 6,135,815

FIELD OF THE INVENTION

The present invention relates to a connector assembly, and more particularly to a connector assembly having an anti-disorientation device.

DESCRIPTION OF PRIOR ART

The prevention of incorrect mating between plug and receptacle connectors is an essential issue since incorrect mating may damage electrical devices connected by the connectors. A power connector assembly includes a male connector having an array of cavities receiving headers therein, and a female connector having an array of sleeves corresponding to the cavities. Each sleeve is assembled with a receptacle which electrically engages with the header when the connectors are mated. However, a 2×9 or 1×11 matrix female connector can be easily inserted into a 2×11 matrix male connector resulting in improper signal transmission, if no anti-mismatching means is provided therewith.

U.S. Pat. No. 4,979,912 discloses a matrix type electrical connector assembly having a male connector and a female connector mated together. A key is formed on the male connector to cooperate with a keyway defined in the female connector for ensuring correct mating therebetween. The '912 patent only discloses a "matrix type" connector assembly and the corresponding key and keyway structure respectively formed on the male connector and the female connector for ensuring correct orientation therebetween when mating. However, the method suggested by '912 is only concerned about the square matrix type connector assembly. U.S. Pat. No. 5,342,221 discloses a system/method for preventing the aforementioned mismatching between the male and female connectors with different numbers of mating ports thereof. Anyhow such structures are too complicated to implement easily. U.S. Pat. No. 6,022,246 provides an easy and systematic method for preventing such mismatching. An object of the invention is to provide another alternative other than those of the aforementioned U.S. Pat. No. 5,342,221 and 6,022,246.

SUMMARY OF THE INVENTION

An objective of the present invention is to provide a connector assembly having anti-disorientation device for ensuring correct mating between male and female connectors thereof.

In order to achieve the objective set forth, a connector assembly comprises a male connector defining at least two cavities within a first outer peripheral wall and a partition arranged therebetween. Each cavity has a header contact assembled therein. A female connector forms at least two sleeve members corresponding to the cavities. Each sleeve member receives a receptacle contact therein. The sleeve member mechanically engages with the corresponding cavity when the male and female connectors are mated. A second peripheral wall surrounds the sleeve members extending from the female connector. The second peripheral wall and the outer sleeve members define a gap therebetween for receiving the first peripheral wall therein.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1A:
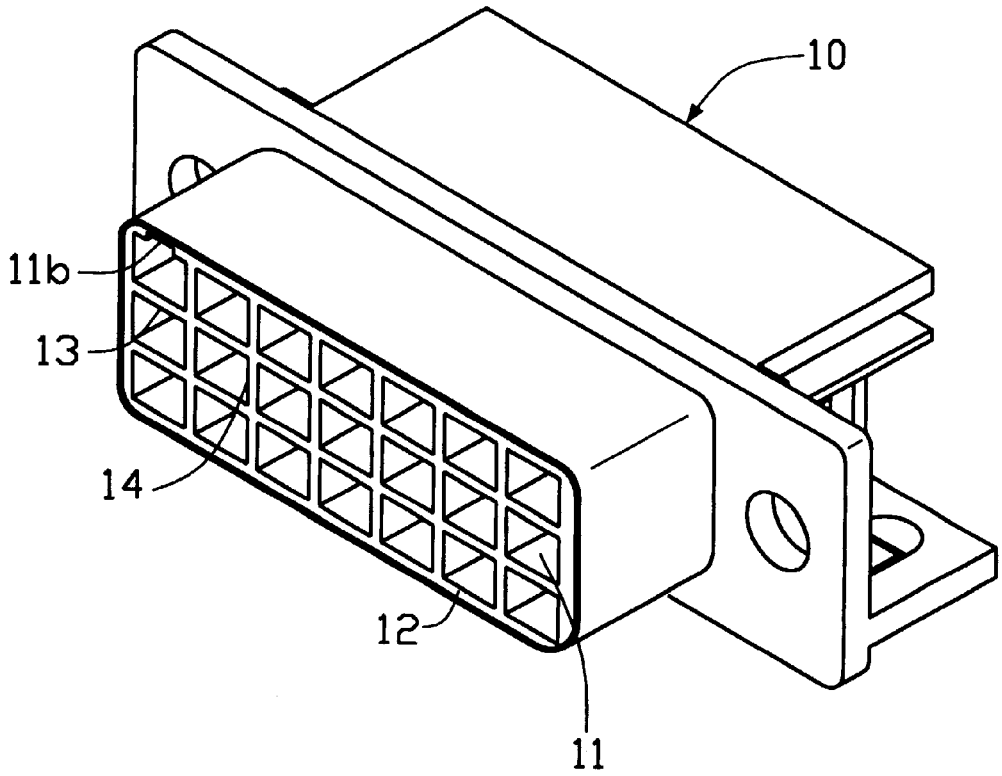
FIG. 1A is a perspective view of a male connector in accordance with the present invention.
Figure 1B:
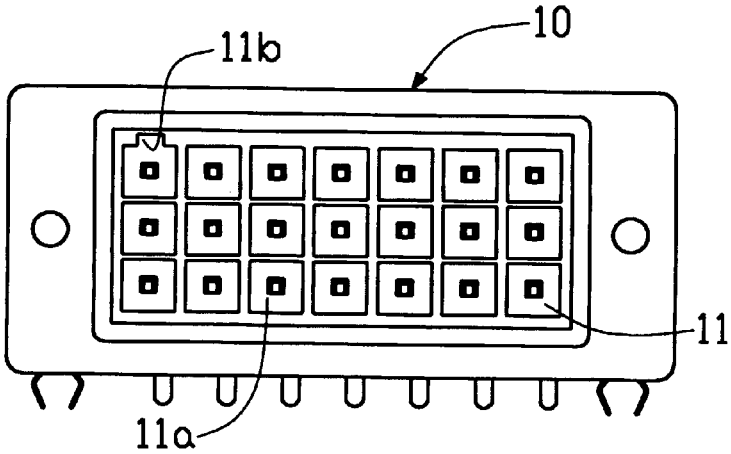
FIG. 1B is a front view of FIG. 1A.
Figure 2A:
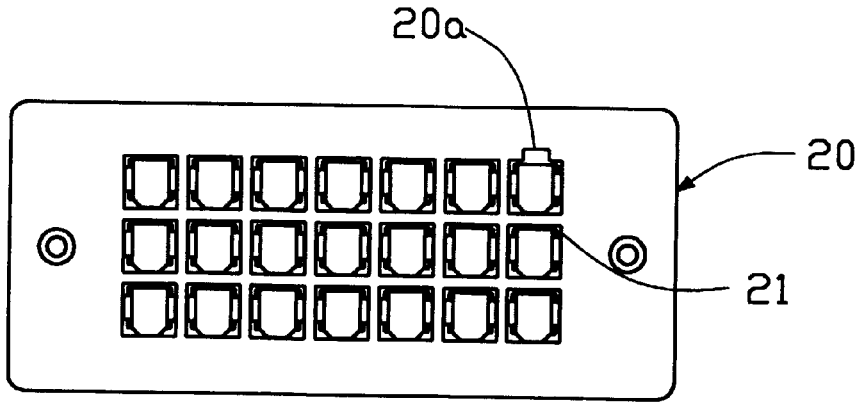
FIG. 2A is a front view of a 3×7 female connector to be mated with the male connector of FIG. 1A.

Referring to FIGS. 1A and 1B, a male power connector 10 in accordance with the present invention defines a 3×7 array of cavities 11. The male connector 10 is generally mounted on a PCB of an electrical system (not shown). Each cavity 11 receives a header contact 11*a* therein. The cavities 11 are defined by a peripheral wall 12 and horizontal and vertical partitions 13, 14. The thickness of the wall 12 is larger than the thickness of the partitions 13, 14. One of the cavities 11 is defined with a keyway 11*b* for providing anti-disorientation capabilities. In this embodiment, the keyway 11*b* is defined in the wall 12 in communication with the cavity 11 located in an upper left corner of the array. Also referring to FIG. 2A, a female connector 20 is mated with the male connector 10. The female connector 20 includes a 3×7 array of sleeve members 21 corresponding to the cavities 11 of the male connector 10. One of the sleeve members 21 forms a key 21*a* thereon for being received in the keyway 11*b*. In this embodiment, the key 21*a* is formed on the upper right sleeve member 21 corresponding to the keyway 11*b* of the male connector 11. In addition, slits 22 defined between the sleeve members 21 are designedly dimensioned to receive the horizontal and vertical partitions 13, 14.

Figure 2B:
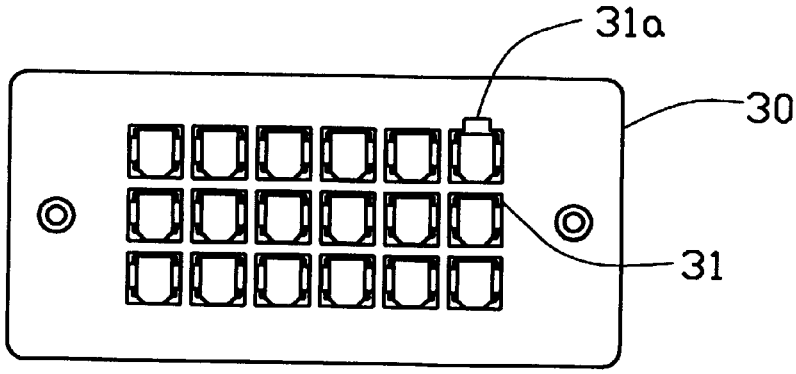
FIG. 2B is a front view of a 3×6 female connector which may be mated with the male connector of FIG. 1A when the key and the corresponding keyway thereof are correctly aligned with each other.
Figure 2C:
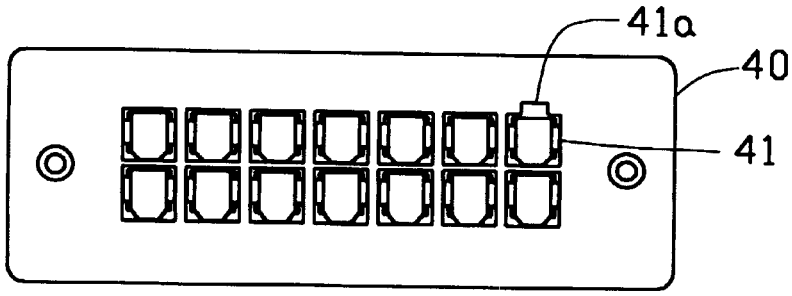
FIG. 2C is a front view of a 2×7 female connector which may be mated with the male connector of FIG. 1A when the key and the corresponding keyway are correctly aligned with each other.

Also referring to FIG. 2B, a female connector 30 having a 3×6 array of sleeve members 31 can also be inserted into the male connector 10 if a key 31*a* thereof is properly aligned with the keyway 11*b*. As seen in FIG. 2C, a female connector 40 having a 2×7 array of sleeve members 41 can also be inserted into the male connector 10 if a key 41*a* thereof is properly aligned with the keyway 11*b*. Since proper mating between connectors is ensured, signal transmission therebetween will not be disrupted. It should be noted that because as mentioned before, the thickness of the wall 12 is larger than that of the partitions 13, 14 or that of the slits 22 between the sleeve members 21, it is impossible to have the female connector with a larger number of the row/column than the male connector, mate with such a male connector. For example, a female connector with 3×7 array ports can not mate with a male connector with 3×6 or 2×7 array ports because the wall 12 of the male connector can not be received within the less dimensioned slit 22 relative to the wall 12. Similarly, even with the same array number between the female connector and the male connector, if such female connector and male connector are misaligned with each other, the wall 12 of the male connector still can not be received within any slit 22 and will prevent mating of the male connector and the female connector.

The foregoing illustration discloses a pair of key and keyway for implementing an anti-disorientation function including preventing 180 degrees reverse mating and further assuring the first port to first port mating between the male connector and the female connector without deviation therebetween, thus resulting in an easy method for mating. Anyhow, most of time mismatching between two male and female connectors with different mating ports, i.e., different array numbers, is undesired, as required in the aforementioned U.S. Pat. No. 5,342,221 and 6,022,246. Therefore, a mating system preventing mismatching between the male connector and the female connector is shown in the following preferred embodiment.

Figure 3A:
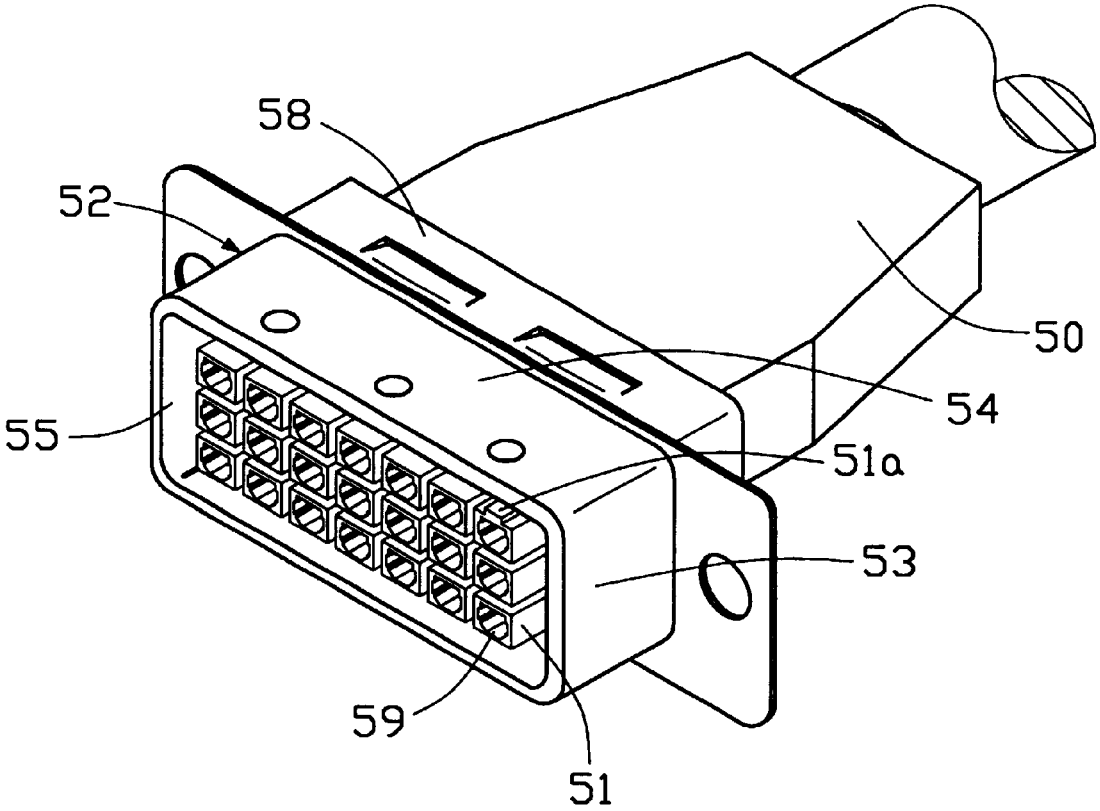
FIG. 3A is a perspective view of a shrouded 3×7 female connector in accordance with the present invention.
Figure 3B:
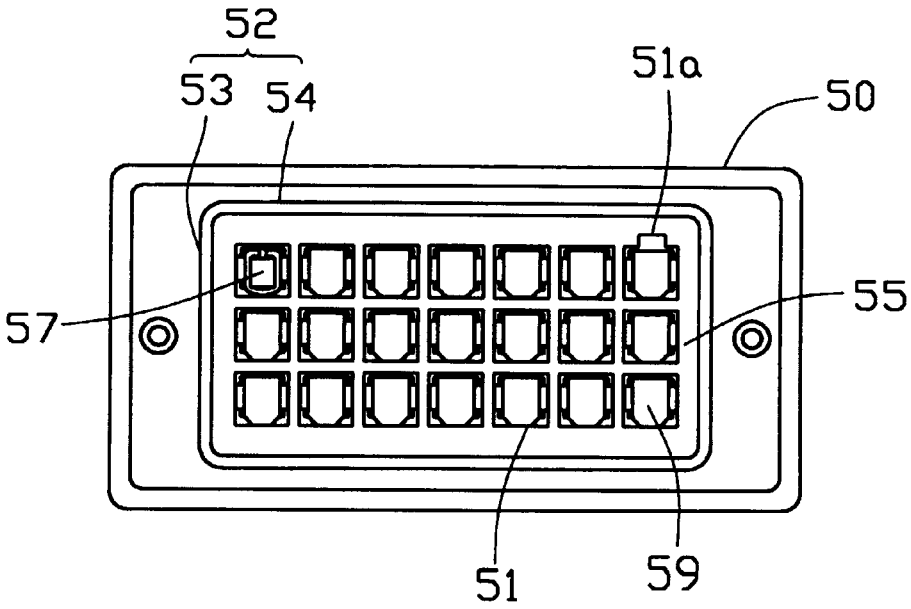
FIG. 3B is a front view of FIG. 3A.

Referring to FIGS. 3A and 3B, a female connector 50 in accordance with the preferred embodiment of the present invention includes a 3×7 array of sleeve members 51 integrally formed with the main body (not shown but covered by the rear shield 58) of the connector 50 corresponding to the cavities 11 of the male connector 10, wherein each sleeve member 51 defines a passage 59 therethrough to receive a receptacle contact 57 (only one shown) therein for mechanical and electrical engagement with the contact 11*a* in the corresponding cavity 11 of the male connector 10 when the male connector 10 and the female connector 50 are mated with each other and such sleeve members 51 of the female connector 50 are respectively snugly received within the corresponding cavities 11 of the male connector 10.

One of the sleeve members 51 forms a key 51*a* thereon which can be received in the keyway 11*b*. In this embodiment, the key 51*a* is formed on the upper right sleeve member 51 corresponding to the keyway 11*b* of the male connector 11. An outer peripheral wall 52 extends from the connector 50. In this embodiment, the outer wall 52 is formed by a metal shroud with EMI shielding assembled to the connector 50. Alternatively, the outer wall 52 may be integrally formed with the sleeve members 51. The outer wall 52 includes longitudinal sides 53 and transverse sides 54. A gap 55 is defined between the outer sleeve members 5 and the outer wall 52. The gap 55 is provided with a predetermined thickness for snugly receiving the peripheral wall 12 of the male connector.

Figure 4A:
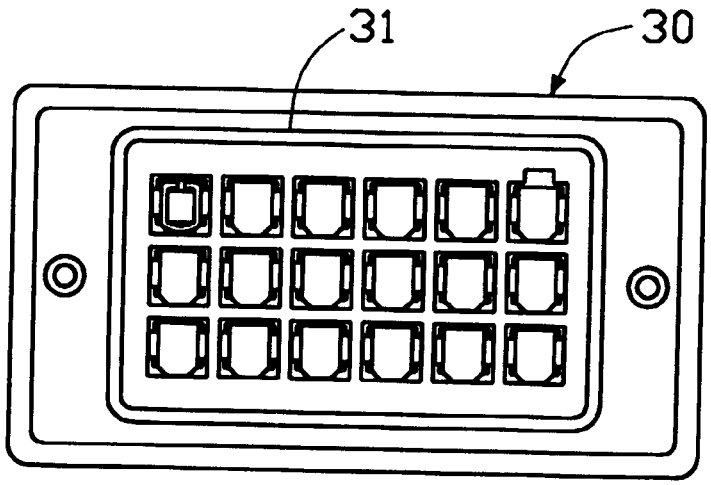
FIG. 4A is a front view of a shrouded 3×6 female connector in accordance with the present invention.
Figure 4B:
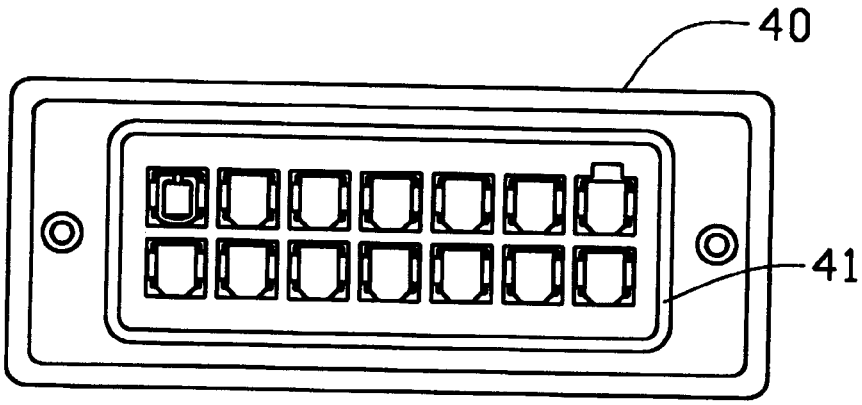
FIG. 4B is a front view of a shrouded 2×7 female connector in accordance with the present invention.

When the outer wall 52 is formed on the female connector 20, only the female connector having the correct number of sleeve members and the properly dimensioned gap defined between the outer wall 52 and the outer sleeve members, can be accurately aligned and mated with a corresponding male connector. In the present invention, the female connector 50 having the outer wall 52 thereof can be mated with the male connector 10 only when both connectors 10, 50 are accurately aligned. In case of any misalignment between the male connector and the female connector even under the same array number therebetween, the longitudinal sides 53 or the transverse sides 54 will be blocked by the horizontal and vertical partitions 13, 14. Understandably, because of installation of such additional outer wall 52 of the female connector 50, which may interfere with the partitions 13, 14 when the female connector having the smaller array number relative to the male connector engages such male connector, mismatching between the male connector and the female connector with different array numbers may be efficiently avoided. By this arrangement, when the female connector 30, 40 is formed with an additional outer wall 31, 41 (FIGS. 4A, 4B) in comparison with that shown in FIGS. 2A–2C, mating thereof with the male connector 10 becomes impossible.

It should be noted that via the outer wall 52, 31, 41, only the female connector and the male connector with the exact same array number can mate with each other in an aligned manner wherein the key 51 a and keyway 11*b* assure no 180 degrees reverse orientation occurs therebetween.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. A connector assembly comprising:

a male connector defining at least two cavities within a first outer peripheral wall and a partition arranged therebetween, each cavity having a header contact assembled therein;

a female connector forming at least two sleeve members corresponding to said cavities, each sleeve member receiving a receptacle contact therein, said sleeve member mechanically engaging with said corresponding cavity when said male and female connectors are mated; and a second peripheral wall surrounding said sleeve members extending from said female connector, said second peripheral wall and said sleeve members defining a gap therebetween for receiving said first outer peripheral wall of said male connector therein;

wherein a thickness of said first peripheral wall is larger than a thickness of said partition between said cavities;

wherein said second peripheral wall is an EMI shroud;

wherein said second peripheral wall is integrally formed with said sleeve members.

* * * * *